US005171124A

United States Patent [19]

Foster

[11] Patent Number: 5,171,124

[45] Date of Patent: Dec. 15, 1992

[54] BACKHOE ATTACHMENT FOR SKID STEER LOADER

[75] Inventor: Phillip W. Foster, Lee, Ill.

[73] Assignee: Farmer's Factory Co., Lee, Ill.

[21] Appl. No.: 787,116

[22] Filed: Nov. 4, 1991

[51] Int. Cl.[5] ..... B66C 23/00

[52] U.S. Cl. ..... 414/685; 212/189; 280/763.1; 414/722

[58] Field of Search ..... 414/685, 686, 694, 722; 212/189; 280/763.1

[56] References Cited

U.S. PATENT DOCUMENTS

| | | | |
|---|---|---|---|
| 2,189,052 | 2/1940 | Anthony | 212/189 X |
| 2,788,906 | 4/1957 | Davis et al. . | |
| 4,049,139 | 9/1977 | Stedman . | |
| 4,355,477 | 10/1982 | Holmgren et al. | 414/685 X |
| 4,461,490 | 7/1984 | Fritel et al. | 212/189 X |
| 4,808,061 | 2/1989 | Cook et al. | 414/695.7 |

FOREIGN PATENT DOCUMENTS

| | | | |
|---|---|---|---|
| 761692 | 11/1956 | United Kingdom | 414/694 |

OTHER PUBLICATIONS

PCT WO8304277, Eriksson, Dec. 1983.

*Primary Examiner*—Michael S. Huppert
*Assistant Examiner*—Donald W. Underwood
*Attorney, Agent, or Firm*—Leydig, Voit & Mayer

[57] ABSTRACT

A backhoe attachment for a skid steer loader includes a dipper stick formed by two separable boom components which reduce the cost of shipping the dipper stick, one of the boom components being constructed as a standard module and the other component being customized in accordance with the particular model of skid steer loader to which the backhoe is to be attached. The two boom components are inclined relative to one another at an obtuse included angle to enable the bucket of the attachment to dig in close proximity to the front of the loader. Detachable stabilizers extend downwardly, outwardly and forwardly from the loader and engage the ground during a digging operation in order to prevent tipping of the loader. Stops are carried by and located above the stabilizers and engage the loading arms of the loader in order to prevent damage to the stabilizers when the loading arms are swung downwardly in front of the vehicle.

7 Claims, 2 Drawing Sheets

BACKHOE ATTACHMENT FOR SKID STEER LOADER

BACKGROUND OF THE INVENTION

This invention relates to a backhoe attachment for a vehicle and specifically for a skid steer loader.

As is well known, a skid steer loader is a relatively small four-wheel vehicle which is steered by braking or driving two wheels on one side of the vehicle while reversely driving the wheels on the other side of the vehicle. Two laterally spaced loader arms are mounted on the rear of the vehicle to swing upwardly and downwardly and, when the arms are swung downwardly, their forward ends extend downwardly in front of the vehicle.

A mounting plate is pivotally supported on the forward ends of the loader arms and normally supports a loader bucket. By pivoting the loader arms and the mounting plate with hydraulic cylinders, the bucket may be maneuvered to different positions to pick up and dump dirt and other materials.

It is known to replace the loader bucket with a backhoe attachment having a dipper stick attached to the mounting plate and having a backhoe bucket pivotally mounted on the lower end of the dipper stick. By pivoting the arms, the mounting plate and the bucket, the latter may be used in the manner of a conventional backhoe to dig a hole or trench and to transport and dump the excavated material.

When a skid steer loader is equipped with a backhoe attachment, the front of the vehicle must be stabilized during the digging operation in order to prevent the vehicle from tipping forwardly. Although skid steer loaders have been provided with stabilizer arms in the past, such stabilizer arms interfere with normal movement of the vehicle and are difficult to install and remove.

SUMMARY OF THE INVENTION

The general aim of the present invention is to provide a skid steer loader having a novel backhoe attachment and having new and improved stabilizer arms which normally allow the vehicle to travel freely over the ground and which may be easily detached when the backhoe attachment is removed from the vehicle.

A further object of the invention is to provide stabilizing arms having self-contained stops for preventing the loader arms from engaging and damaging the stabilizing arms and other components when the loader arms are swung downwardly.

A further object is to provide a backhoe attachment having a unique dipper stick formed by two separable boom components which facilitate shipment of the components and which simplify adapting the backhoe attachment to different types of vehicles.

The invention also resides in the unique angled relation between the two boom components of the dipper stick to enable the backhoe bucket to dig in areas in close proximity to the front of the vehicle.

These and other objects and advantages of the invention will become more apparent from the following detailed description when taken in conjunction with the accompanying drawings.

DETAILED DESCRIPTION OF THE PREFERRED EMBODIMENT

Figure 1:
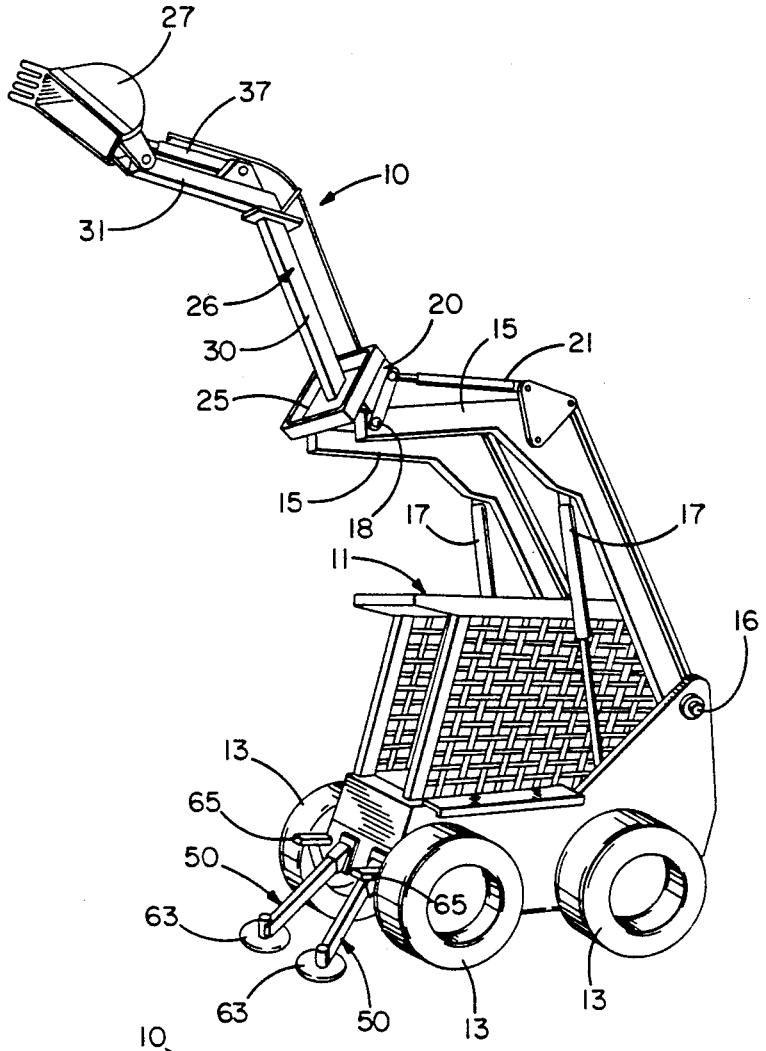
FIG. 1 is a perspective view of a typical skid steer loader equipped with a new and improved backhoe attachment incorporating the unique features of the present invention.

For purposes of illustration, the invention has been shown in the drawings as embodied in a backhoe attachment 10 for use with a vehicle 11 of the type conventionally known as a skid steer loader. The vehicle is comparatively small, is supported and driven by four wheels 13 and is steered by driving or braking the wheels on one side of the vehicle while reversely driving the other two wheels.

The vehicle 11 includes a pair of laterally spaced loading arms 15 which are pivotally supported at 16 near the rear of the vehicle to swing upwardly and downwardly under the control of a pair of reciprocating hydraulic actuators 17. Pivotally connected at 18 to the forward ends of the arms is a mounting plate 20 adapted to be rocked about a laterally extending horizontal axis by two reciprocating hydraulic actuators 21, only one of the actuators 21 being visible.

Normally, a loading bucket (not shown) is attached to the mounting plate 20. By raising and lowering the arms 15 and by rocking the loading bucket about the pivot axis 18 of the mounting plate, the bucket may be used to scoop up dirt or other material and to lift the material to a higher elevation for dumping in a truck or the like.

The present backhoe attachment 10 is adapted to be connected to the mounting plate 20 in lieu of the loader bucket and is adapted to be used to dig holes, trenches or other excavations and to elevate the excavated material for dumping into a truck or for transfer to a different location. In general, the backhoe attachment 10 includes a mounting frame 25 adapted to be detachably secured to the mounting plate 20, a dipper stick 26 extending forwardly from the mounting frame, and a digging bucket 27 pivotally connected to the lower end of the dipper stick.

According to one aspect of the present invention, the dipper stick 26 is constructed as two separable boom components 30 and 31 which carry the mounting frame 25 and the digging bucket 27, respectively. By constructing the dipper stick 26 as two separable boom components 30 and 31, the dipper stick may be shipped as a more compact package and, in addition, the digging bucket may be easily mated to different types of mounting frames for use with different models of skid steer loaders.

More specifically, the backhoe attachment 10 which has been illustrated is for use with a CASE 1845C skid steer loader 11. The mounting frame 25 is generally rectangular and is specifically constructed to be coupled to the particular mounting plate 20 of the CASE 1845C loader. The mounting frame 25 is welded to the rear end of the rear boom 30 and is disposed at an angle A of about 125 degrees relative to the lower side of the rear boom. If the backhoe attachment 10 is to be used with a different model of skid steer loader, a different mounting frame compatible with the mounting plate of that loader is welded to the rear end of the rear boom. Also, the relationship between the rear boom and the mounting plate may be different from that shown and the rear boom may be of a different length.

Figure 2:
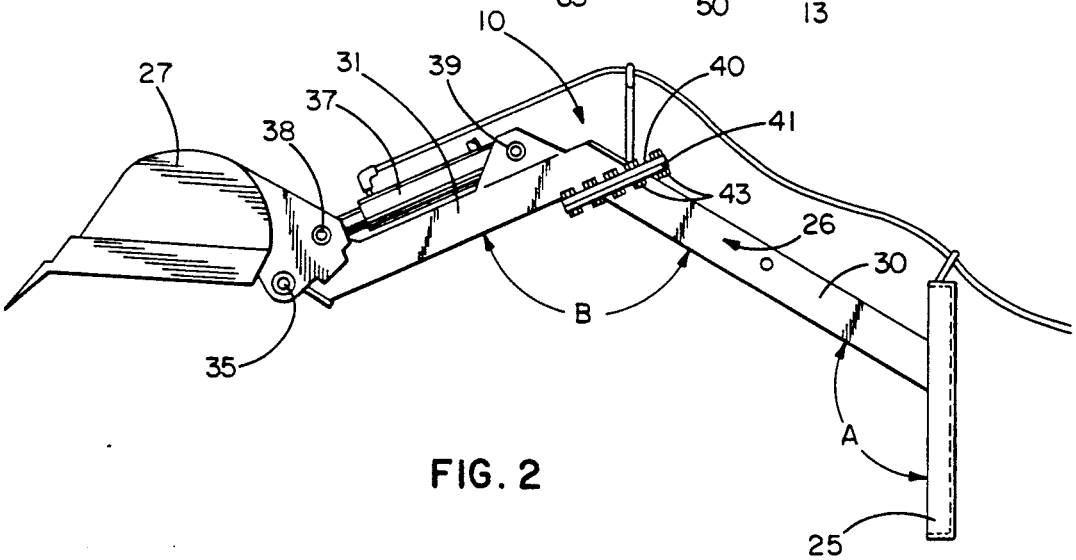
FIG. 2 is an enlarged side elevational view of the backhoe attachment shown in FIG. 1.

The digging bucket 27 is pivotally attached at 35 (FIG. 2) to the lower end of the lower boom 31 and may be of various sizes (e.g., 12", 18" or 24"). A hydraulic actuator 37 is pivotally connected at 38 to the bucket and at 39 to the boom 31 and serves to rock the bucket back and forth relative to the boom during digging and dumping of the earth or other excavated material.

Figure 3:
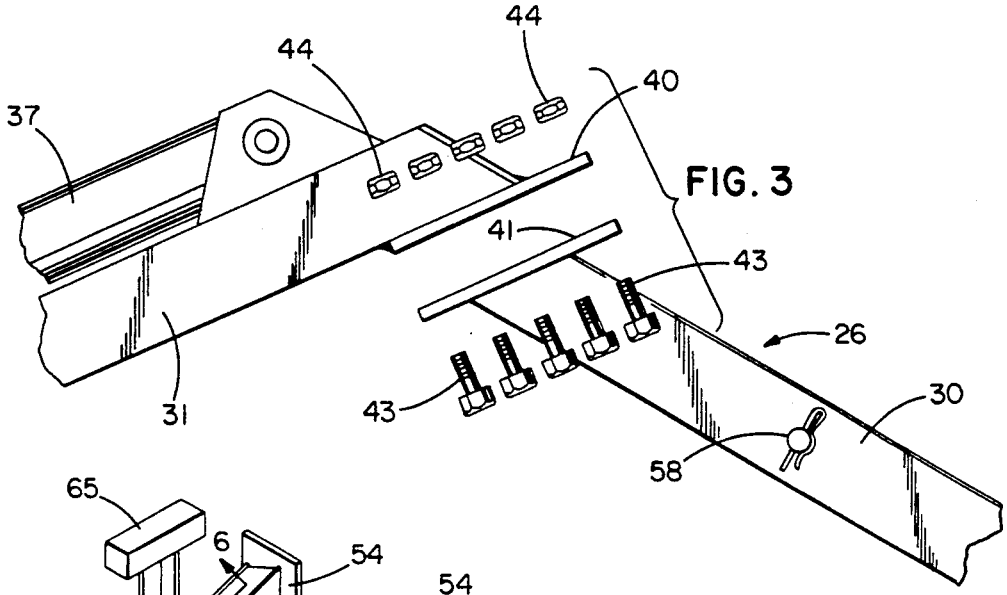
FIG. 3 is an enlarged exploded side elevational view of portions of the boom components of the dipper stick of the backhoe attachment.

In carrying out the invention, the upper end of the lower boom 31 is detachably connected to the forward end of the rear boom 30. For this purpose, a generally rectangular mounting flange 40 (FIG. 3) is welded to the upper end of the lower boom 31 while a similar flange 41 is welded to the forward end of the rear boom 30. The two flanges are disposed in face-to-face relation and are formed with a series of angularly spaced and angularly aligned holes which receive fasteners in the form of bolts 43. Nuts 44 are threaded onto the bolts and clamp the flanges 40 and 41 together so as to hold the two booms in assembled relation.

With the foregoing arrangement, the dipper stick 26 may be shipped to the implement dealer or customer as two separate boom components 30 and 31 rather than as a single large and cumbersome assembly. This simplifies preparing the dipper stick for shipment and reduces the bulk of the shipment so as to lower shipping costs. The two boom components may be easily assembled through use of the flanges 40 and 41 and the bolts 43 prior to installation of the backhoe attachment 10 on the loader 11.

Construction of the dipper stick 26 as two separate boom components 30 and 31 also enables modular manufacture of the dipper stick. That is to say, the lower boom 31 may be made as a standard module for all types of loaders and need only be fitted with a bucket 27 of appropriate size while the rear boom 30 and the mounting frame 25 may be made as a customized module as required for a particular model of loader. Thus, it is not necessary to customize the entire dipper stick for each different model of loader.

Advantageously, the two boom components 30 and 31 of the dipper stick 26 are located such that the lower sides of the booms are disposed at an obtuse included angle B (FIG. 2) of about 125 degrees. By virtue of the angled relation between the booms 30 and 31, the bucket 27 may dig closer to the front of the vehicle 11 than would be the case if the dipper stick 26 were straight and disposed at the angle A relative to the mounting frame 25.

When the backhoe attachment 10 is digging, the loader 11 must be stabilized in order to prevent the rear end of the loader from being tipped upwardly and forwardly by the force created during the digging. In accordance with another aspect of the invention, provision is made of detachable stabilizers 50 which steady the loader during digging but which are located and constructed so as to avoid interfering with movement of the loader as the loader is maneuvered during the digging operation. Herein, there are two laterally spaced stabilizers 50 secured to and extending forwardly from the forward end of the loader, the two stabilizers diverging away from one another as they progress forwardly.

More specifically, each stabilizer 50 includes an arm 51 which herein is made of tubular steel of square cross-section. Each arm is telescoped slidably into a complementary shaped steel tubular member or sleeve 52 which forms part of a mounting bracket 53 adapted to be attached to the front end of the loader 11, the bracket herein including an L-shaped member 54 rigid with the sleeve and secured to the loader by bolts or the like (not shown). Each sleeve 52 extends downwardly, forwardly and outwardly from the front of the loader.

Figure 6:
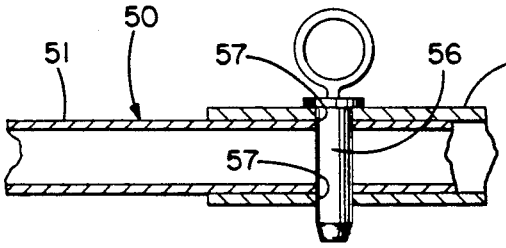
FIG. 6 is an enlarged fragmentary cross-section taken substantially along the line 6—6 of FIG. 4.

A pin 56 (FIG. 6) extends through holes 57 in each stabilizing arm 51 and sleeve 52 to hold the arm in telescoped relation with the sleeve. By removing the pins 56, the stabilizing arms 51 may be pulled out of the sleeves 52 and completely detached from the loader 11 when the loader is being used for tasks other than digging with the backhoe attachment 10. When not in active use, the stabilizer arms 50 may be stored on pins 58 on the sides of the rear boom 30, one of the pins being shown in FIG. 3 and being adapted for insertion through the holes 57 in the arm 51.

A generally vertical and tubular hub 60 (FIG. 5) is welded to the lower end portion of each stabilizing arm 51 and rotatably supports a generally vertical rod 62. Carried on the lower end of each rod is a saucer-shaped foot 63 whose convexly curved bottom normally is spaced about 4" above the ground. As a result, the feet 63 normally allow the loader 11 to travel over the terrain and to maneuver as necessary when positioning and dumping the bucket 27. When the bucket is digging, however, the feet engage the ground after the rear end of the loader has been tipped upwardly and forwardly through a slight angle by the force applied to the bucket. By virtue of such engagement, the feet prevent any further tipping of the loader and thus hold the loader in a safe and stable position as the bucket digs into the earth.

Figure 4:
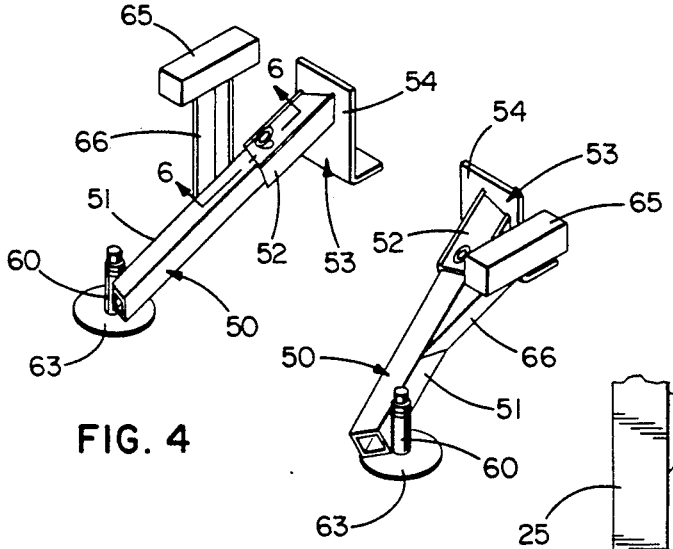
FIG. 4 is a perspective view showing stabilizers for preventing forward tipping of the vehicle during use of the backhoe attachment.

Importantly, means are provided for stopping the loader arms 15 and preventing the mounting frame 25 from engaging and damaging the stabilizing arms 51 when the loader arms are lowered downwardly in front of the loader 11 to enable the bucket 27 to reach into a deep hole. In the specific embodiment which has been illustrated, these means comprise fore-and-aft extending and generally horizontal stop bars 65 (FIGS. 4 and 5) located above the rear end portions of the stabilizing arms 51. Each stop bar 65 is welded to the upper end of a strut 66 whose lower end is advantageously welded to the outboard side of the stabilizing arm 51 so that the struts and the stop bars may be removed from the loader 11 along with the stabilizing arms when the latter are not required.

Figure 5:
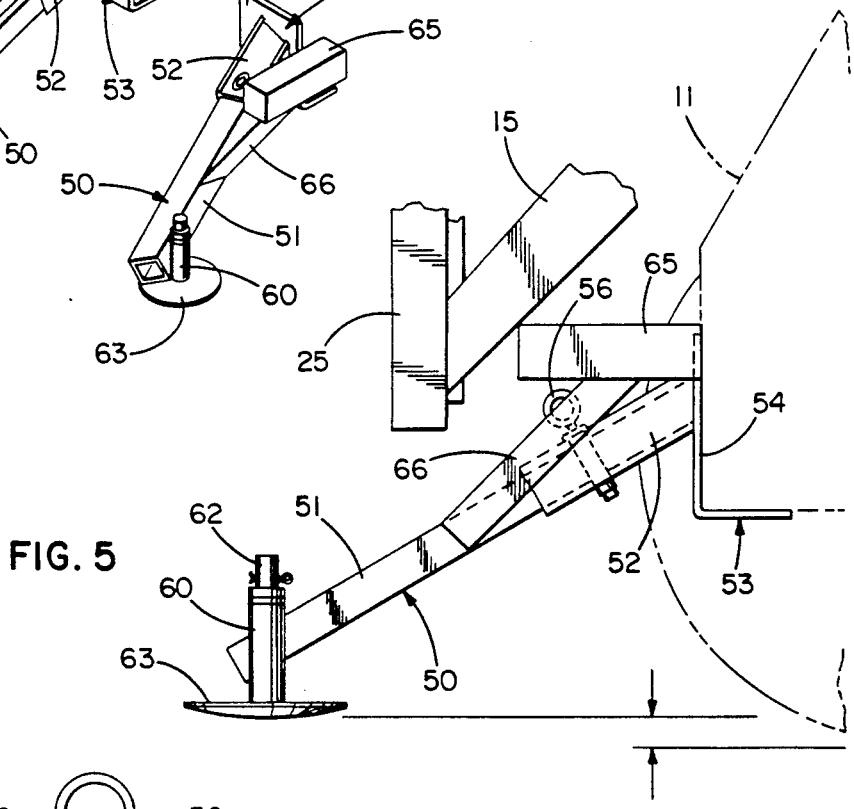
FIG. 5 is an enlarged side elevational view of one of the stabilizers shown in FIG. 4.

The struts 65 extend upwardly and outwardly from the stabilizing arms 51 and locate the stop bars 65 in generally horizontal positions above the stabilizing arms and in lateral alignment with the loader arms 15. When the latter are lowered downwardly in front of the loader 11, their forward end portions engage and are stopped by the bars 65 as shown in FIG. 5. This prevents the mounting frame 25 from crashing into and damaging the stabilizing arms 51 and also avoids damage to the mounting frame.

I claim:

1. A skid steer loader comprising a wheeled vehicle having a pair of laterally spaced loader arms mounted to swing upwardly and downwardly on the rear of the vehicle, said loader arms having forward end portions which extend downwardly in front of the vehicle when the arms are swung downwardly, a dipper stick pivotally connected to the forward end portions of said loader arms, a backhoe bucket pivotally connected to said dipper stick, a pair of laterally spaced stabilizer arms attached to and extending forwardly from said vehicle and having ground-engaging feet for stabilizing said vehicle during digging by said bucket, and a pair of laterally spaced stops secured to and located above said stabilizer arms, said stops engaging said loader arms and limiting downward swinging thereof when said loader arms are swung downwardly in front of the vehicle.

2. A skid steer loader as defined in claim 1 further including a pair of laterally spaced mounting brackets fastened to the front of said vehicle, and means for removably attaching said stabilizer arms to said mounting brackets.

3. A skid steer loader as defined in claim 2 in which each of said mounting brackets comprises a tubular member projecting downwardly, forwardly and outwardly from the front of said vehicle, said stabilizer arms being telescoped slidably into said tubular members, said attaching means comprising pins extending removably through said tubular members and said stabilizer arms to hold said stabilizer arms in telescoped relation with said tubular members.

4. A skid steer loader as defined in claim 1 further including a strut extending upwardly and outwardly from each of said stabilizer arms and having an upper end, said stops comprising generally horizontal and forwardly extending bars secured to the upper ends of said struts.

5. A skid steer loader comprising a wheeled vehicle having a pair of laterally spaced loader arms mounted to swing upwardly and downwardly on the rear of the vehicle, said loader arms having forward end portions which extend downwardly in front of the vehicle when the arms are swung downwardly, a dipper stick pivotally connected to the forward end portions of said loader arms, a backhoe bucket pivotally connected to said dipper stick, a pair of laterally spaced stabilizer arms having stabilizing feet, a pair of laterally spaced mounting brackets fastened to the front of said vehicle, each of said brackets comprising a tubular member projecting downwardly, forwardly and outwardly from the front of said vehicle, said stabilizer arms being telescoped slidably into said tubular members and extending downwardly, forwardly and outwardly from the front of said vehicle, and means holding said stabilizer arms in telescoped relation with said tubular members, said means normally preventing said stabilizer arms from sliding within said tubular members and being selectively removable to permit said stabilizer arms to be completely pulled out of said tubular members and removed from said vehicle, said tubular members, said stabilizer arms and said feet being located such that said feet are normally spaced above the ground to permit free travel of said vehicle but engage the ground to stabilize the vehicle during digging by said bucket.

6. A skid steer loader as defined in claim 5 in which said feet are generally saucer-shaped and include convexly curved bottoms, said feet being supported by said arms to rotate about upright axis.

7. A wheeled vehicle having a pair of laterally spaced arms mounted to swing upwardly and downwardly on the rear of the vehicle, said arms having forward end portions which extend downwardly in front of the vehicle when the arms are swung downwardly, a mounting plate pivotally attached to the forward end portions of said arms to swing about a horizontal axis relative to said arms, and a backhoe attachment for said vehicle, said backhoe attachment comprising a mounting frame adapted to be secured detachably to said mounting plate, a first boom attached to and extending forwardly from said mounting frame and having a forward end portion, a second boom having upper and lower end portions, a backhoe bucket pivotally connected to the lower end portion of said second boom, and means connecting the upper end portion of said second boom to the forward end portion of said first boom and locating said second boom at an obtuse included angle relative to said first boom, said connecting means comprising a first mounting flange secured to the forward end portion of said first boom, a second mounting flange secured to the upper end portion of said second boom and disposed in face-to-face relation with said first mounting flange, and a plurality of threaded fasteners extending through said mounting flanges and detachably connecting said flanges to one another.

* * * * *